US007907883B2

(12) United States Patent
Thayer et al.

(10) Patent No.: US 7,907,883 B2
(45) Date of Patent: Mar. 15, 2011

(54) METHOD AND APPARATUS FOR ELECTROSTATIC BRUSH CLEANING IN AN IMAGE PRODUCTION DEVICE

(75) Inventors: Bruce Earl Thayer, Webster, NY (US); Clark Vaughn Lange, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 451 days.

(21) Appl. No.: 12/175,850

(22) Filed: Jul. 18, 2008

(65) Prior Publication Data

US 2010/0014883 A1 Jan. 21, 2010

(51) Int. Cl.
*G03G 21/00* (2006.01)

(52) U.S. Cl. ..... 399/343; 399/71; 399/353

(58) Field of Classification Search ..... 399/71, 399/343, 353–35

See application file for complete search history.

(56) References Cited

U.S. PATENT DOCUMENTS

| | | | | |
|---|---|---|---|---|
| 5,652,951 | A * | 7/1997 | Thayer et al. | 399/71 |
| 5,701,572 | A | 12/1997 | Behe et al. | |
| 5,729,815 | A * | 3/1998 | Lindblad et al. | 399/354 |
| 5,903,797 | A | 5/1999 | Daniels et al. | |
| 2007/0212139 | A1 * | 9/2007 | Sugiura et al. | 399/353 |

* cited by examiner

*Primary Examiner* — David M Gray
*Assistant Examiner* — Roy Yi
(74) *Attorney, Agent, or Firm* — Ronald E. Prass, Jr.; Prass LLP

(57) ABSTRACT

A method and apparatus for electrostatic brush cleaning of excess toner particles on a photoreceptor device in an image production device is disclosed. The method may include determining if an image transfer occurred in the image production device, wherein if it is determined that the image transfer occurred, rotating one or more electrostatic brushes at a first speed, and if it is determined that the image transfer did not occur, rotating the one or more electrostatic brushes at a second speed, wherein the first speed is slower than the second speed.

20 Claims, 6 Drawing Sheets

METHOD AND APPARATUS FOR ELECTROSTATIC BRUSH CLEANING IN AN IMAGE PRODUCTION DEVICE

BACKGROUND

Disclosed herein is a method for electrostatic brush cleaning in an image production device, as well as corresponding apparatus and computer-readable medium.

High speed, high volume printers typically use electrostatic brush cleaners. These cleaners are designed to reliably clean up to a maximum toner input rate. When the maximum toner input rate is exceeded, more than a single pass through the cleaning system is required to completely remove toner from the photoreceptor.

The highest toner input to the cleaner occurs when the printer is recovering from a paper jam. Untransferred, full-developed density images, rather than normal low density post-transfer residual, must be cleaned in a specified number of photoreceptor jam recovery cycles. When a jam occurs, the printer performs the number of jam recovery cycles needed for maximum toner input independent of the actual toner input rate to the cleaner. This process results in lost productivity due to longer jam recovery time than needed for most documents. During normal operation, with low density input, the cleaner continues to operate at the high cleaning capacity condition causing unnecessary wear on the cleaning system and photoreceptor.

SUMMARY

A method and apparatus for electrostatic brush cleaning of excess toner particles on a photoreceptor device in an image production device is disclosed. The method may include determining if an image transfer occurred in the image production device, wherein if it is determined that the image transfer occurred, rotating one or more electrostatic brushes at a first speed, and if it is determined that the image transfer did not occur, rotating the one or more electrostatic brushes at a second speed, wherein the first speed is slower than the second speed.

DETAILED DESCRIPTION

Figure 1:
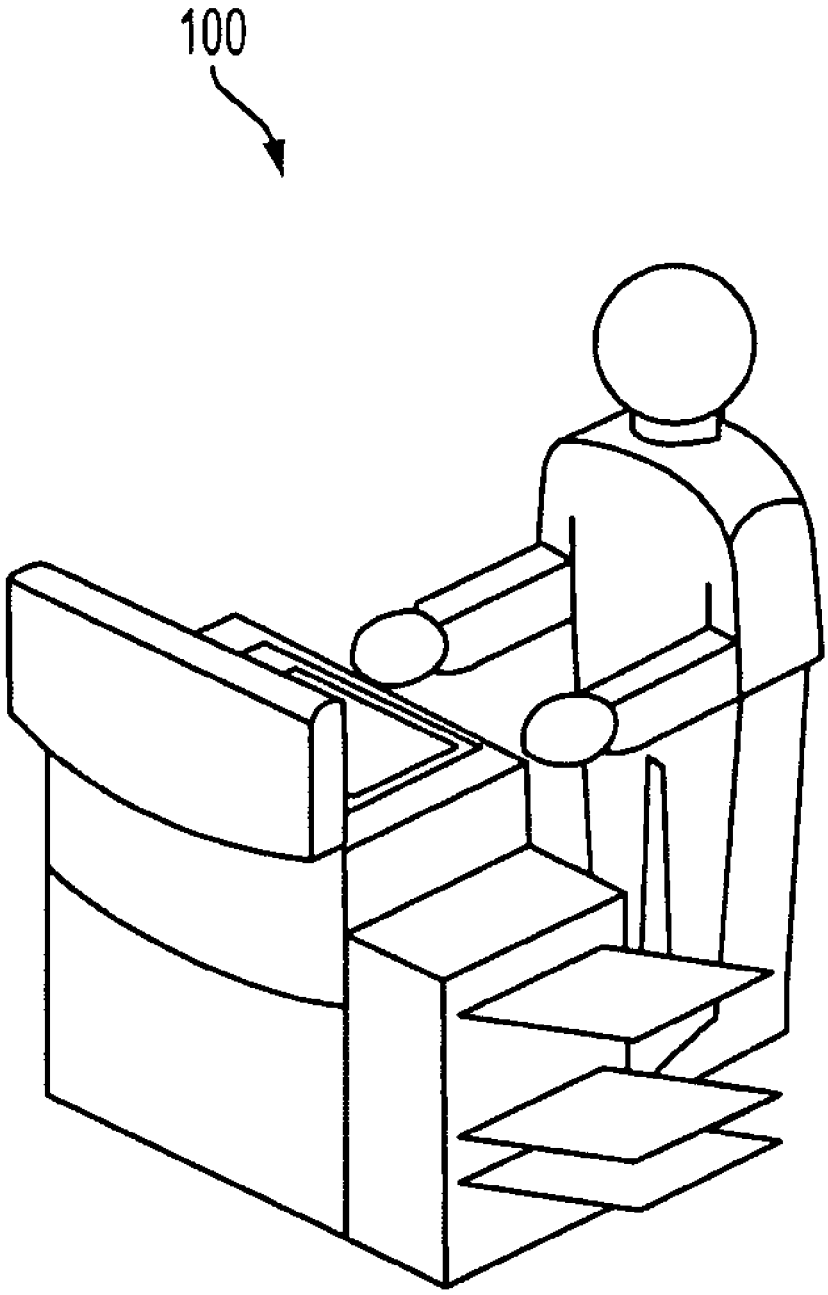
FIG. 1 is an exemplary diagram of an image production device in accordance with one possible embodiment of the disclosure.

Aspects of the embodiments disclosed herein relate to a method for high capacity copying and printing in an image production device, as well as corresponding apparatus and computer-readable medium.

The disclosed embodiments may include a method for electrostatic brush cleaning of excess toner particles on a photoreceptor device in an image production device. The method may include determining if an image transfer occurred in the image production device, wherein if it is determined that the image transfer occurred, rotating one or more electrostatic brushes at a first speed, and if it is determined that the image transfer did not occur, rotating the one or more electrostatic brushes at a second speed, wherein the first speed is slower than the second speed.

The disclosed embodiments may further include an image production device that may include a photoreceptor device, one or more electrostatic brushes that remove excess toner particles from the photoreceptor device, and an electrostatic brush cleaning controller that determines if an image transfer occurred in the image production device, wherein if electrostatic brush cleaning controller determines that the image transfer occurred, the electrostatic brush cleaning controller rotates the one or more electrostatic brushes at a first speed, and if the electrostatic brush cleaning controller determines that the image transfer did not occur, the electrostatic brush cleaning controller rotates the one or more electrostatic brushes at a second speed, wherein the first speed is slower than the second speed.

The disclosed embodiments may further include an electrostatic brush cleaning section for use in an image production device. The electrostatic brush cleaning section may include a photoreceptor device, and one or more electrostatic brushes that remove excess toner particles from the photoreceptor device, wherein if an image transfer occurred in the image production device, the one or more electrostatic brushes rotate at a first speed, and if the image transfer did not occur, the one or more electrostatic brushes rotate at a second speed, wherein the first speed is slower than the second speed.

This disclosure may concern modifying an electrostatic brush cleaner to operate in varying cleaning capacity modes. During normal machine operation, when input to the cleaner consists of very low density residual toner from transfer, the cleaner may operate in a reduced cleaning capacity mode, e.g., slow brush speed. During high cleaning stress conditions, such as cleaning untransferred images during jam recovery, the cleaner may operate in a high cleaning capacity mode, e.g., high brush speed. By sensing the toner input to the cleaner, during jam recovery the number of cleaning cycles required to clean the untransferred pages may be optimized. Jam recovery cycles can be reduced for low toner input and increased for high toner input. Operating at a cleaning capacity matching the toner input to the cleaner reduces machine wear and contamination and increases reliability, life and productivity.

High speed, high volume image production devices (such as printers and copiers) typically use electrostatic brush (ESB) cleaners. These cleaners may be designed to reliably clean up to a maximum toner input rate in a single pass under the cleaner. When the maximum toner input rate is exceeded, more than a single pass through the cleaning system may be required to completely remove toner from the photoreceptor. The highest toner input to the cleaner may occur when the printer or copier is recovering from a paper jam. Untransferred, full developed density images, rather than low density post-transfer residual, may be cleaned in a specified number of photoreceptor jam recovery cycles. Typically two jam recovery cycles may be used, but occasionally three or more cycles may be allowed.

Since transfer efficiencies are typically 90% or higher, the requirement to clean high input toner rates during jam recovery may result in the cleaning requirement being much less than maximum cleaning capacity during normal operation. When a jam occurs the printer performs the number of jam recovery cycles needed for maximum toner input, independent of the actual toner input rate to the cleaner. This results in lost productivity due to longer jam recovery time than needed for most documents. For some machines, approximately 40% of the documents printed are less than 6% area coverage.

To avoid unnecessary cycling of the machine during jam recovery, this disclosure may concern optimizing the number of jam recovery cycles based on the number of cleaning passes required to clean the actual toner on the jammed images. Image characteristic limit criteria may be established for single pass cleaning. The image characteristics of the jammed images may be measured and compared to the limit criteria. If the jammed images exceed the limit criteria then additional cleaning passes may be required during jam recovery. The jammed image characteristics may be measured by evaluating the image on the photoreceptor, for example, with a full width array sensor (micro-densitometer array) or the electronic data representing the image can be examined. If the electronic data has been examined, then the number of jam recovery cycles may be determined based on the cleaning capacity of the ESB cleaner.

If the actual toner image on the photoreceptor is detected by a sensor, then the jam recovery cycles may continue until the image toner has been completely removed by the cleaner. Use of a sensor may provide the advantage of compensating for possible degradation in cleaning efficiency. When the machine is operating normally, cleaner parameters may be adjusted to reduce the cleaning capacity to the level required for transfer residual input cleaning. For most cleaners, this may be 10% to 20% of maximum cleaning capacity.

Operating in a reduced cleaning capacity condition results in a reduction in machine and cleaner deterioration and may lead to extensions in system and cleaner lives. The cleaner may be set to a specified reduced cleaning capacity condition or if the toner image is being evaluated with a sensor, the cleaning capacity condition may be varied to match the toner input. Use of the sensor system may capture more of the possible increases in system and cleaner life due to deterioration reduction.

Cleaning capacity may be reduced through changes to electrostatic or mechanical conditions. The electrostatic conditions may relate to toner charge and the electric field that attracts the charged toner particles to the cleaning brush fibers. Toner charge may be controlled by modifying toner particle charges before they enter the brush nip with the pre-clean charge device. The electric field attracting toner to fibers may be controlled by the ESB bias voltage. Reductions in charge current or brush bias are unlikely to result in charge device or cleaner brush life improvements greater than about 10%. Xerographic system life may be increased due to a reduction in photoreceptor charging by the cleaning system.

The mechanical conditions that can be altered during machine operation may be brush-to-photoreceptor interference and brush speed. Both interference and speed reduce the forces of the brush on the photoreceptor surface. The brush set may be reduced, but the impact may not be significant. Reducing the interference and/or speed may reduce wear of brush fiber tips and reduce buildup due to impaction of toner, etc. on the brush fiber tips. These changes may be unlikely to produce large improvements in cleaner brush life unless a problem due to brush wear or impaction already exists.

Significant improvements in photoreceptor life may be possible, however, due to the reduction in brush contact forces. Reducing brush-to-photoreceptor interference may be helpful, but reductions in brush speed may be more effective and more easily accomplished. Testing has consistently shown that brush speed may be the key factor in reducing photoreceptor filming, scratching and wear. By reducing brush speed to the minimum required for the cleaning input conditions, photoreceptor life may be increased.

The benefits of reduced jam recovery cycling may include improvement in productivity for the customer and improved machine reliability because of reduced usage, contamination and wear. By also operating the cleaner at a reduce cleaning capacity condition during normal operation the cleaner, machine and especially the photoreceptor may benefit from reduced cycling, contamination and wear.

The benefits of this process may be applied to low area coverage prints that consist mainly of text and some small non-text image features. Because a large fraction of prints are low area coverage, this process may be applied often enough to make a significant impact on machine productivity and reliability during jam recovery. The benefits of a reduced cleaning capacity mode during normal machine operation maybe realized even if jam recovery cycles are not optimized (slow speed for normal cleaning, high speed for fixed multi-pass jam recovery).

Benefits of cleaner input sensing for jam recovery optimization and improved machine life and reliability may include:

- Reduced Jam Recovery Cycles
  - Greater productivity for customer—reduced recovery time following jam
  - Improved machine reliability—fewer machine cycles, especially beneficial to photoreceptor
- Cleaner Operation in Reduced Cleaning Capacity Condition—reduced brush speed
  - Longer brush life—reduced wear and/or toner accumulation on fiber tips
  - Longer photoreceptor life—reduced wear, scratching and/or filming
  - Improved machine reliability—reduced toner contamination with slower brushes
- Some possible process variations
  - A. Two speed ESB cleaning
    - Low speed for cleaning post-transfer residual (low stress)
    - High speed for jam recovery (high stress) as currently practiced—including multiple passes
  - B. Two speed ESB cleaning with feed-forward optimization of jam recovery cycles
    - Low speed for cleaning post-transfer residual (low stress)
    - High speed for jam recovery (high stress)
    - Number of jam recovery cleaning cycles determined through feed-forward interrogation of digital electronic image representation
  - C. Two speed ESB cleaning with sensing of toner past the cleaner
    - Low speed for cleaning post-transfer residual (low stress)
    - High speed for jam recovery (high stress)
    - Jam recovery cycles continue until sensor indicates that photoreceptor is clean
  - D. Two speed ESB cleaning with feed-forward optimization and verification of jam recovery cycles
    - Low speed for cleaning post-transfer residual (low stress)
    - High speed for jam recovery (high stress)
    - Number of jam recovery cleaning cycles determined through feed-forward interrogation of digital electronic image representation Sensor verifies that photoreceptor is clean after the number of cycles determined using feed-forward E. Two speed ESB cleaning with feed-forward optimization, verification of cleaning and diagnosis of machine performance Low speed for cleaning post-transfer residual (low stress)

High speed for jam recovery (high stress)

Number of jam recovery cleaning cycles determined through feed-forward interrogation of digital electronic image representation Sensor measures cleaning after the number of cycles determined using feed-forward If complete cleaning is not accomplished after the number of cycles determined using feed-forward, then further investigation may be needed to discover the cause of higher than expected toner input or lower than expected cleaning capacity.

FIG. 1 is an exemplary diagram of an image production device 100 in accordance with one possible embodiment of the disclosure. The image production device 100 may be any device that may be capable of making image production documents (e.g., printed documents, copies, etc.) including a copier, a printer, a facsimile device, and a multi-function device (MFD), for example.

Figure 2:
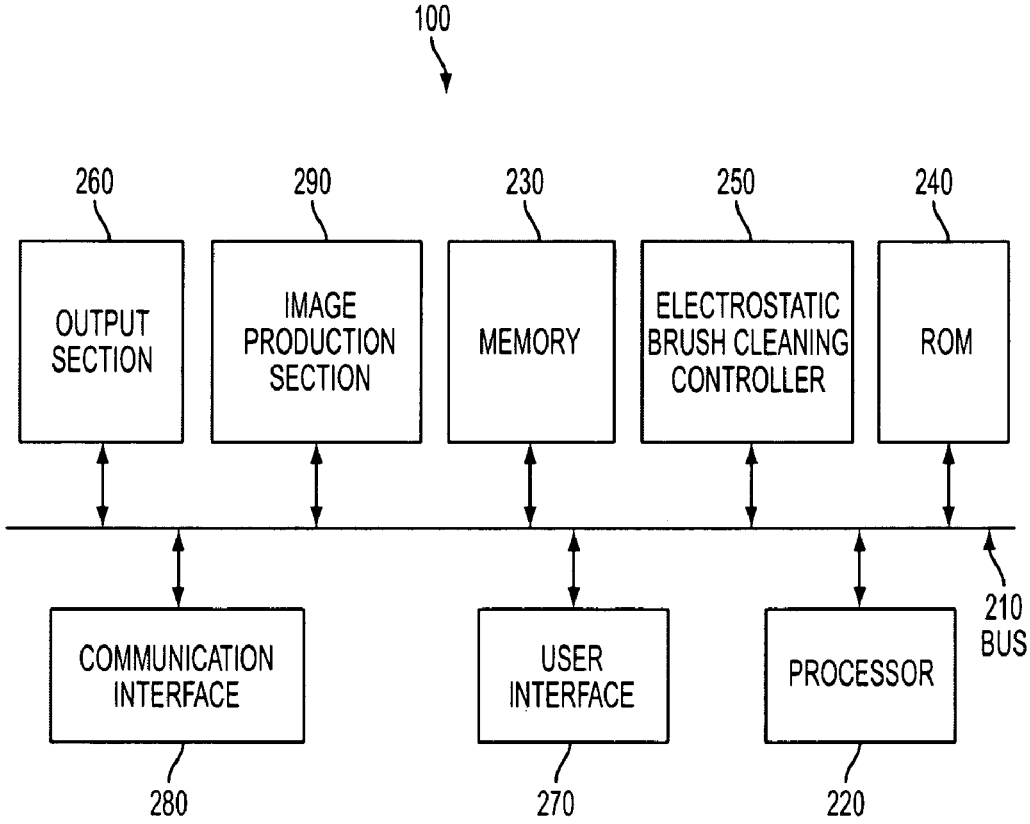
FIG. 2 is a exemplary block diagram of the image production device in accordance with one possible embodiment of the disclosure.

FIG. 2 is an exemplary block diagram of the image production device 100 in accordance with one possible embodiment of the disclosure. The image production device 100 may include a bus 210, a processor 220, a memory 230, a read only memory (ROM) 240, an electrostatic brush (ESB) cleaning controller 250, a user interface 260, an output section 270, a communication interface 280, and an image production section 290. Bus 210 may permit communication among the components of the image production device 100.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

User interface 260 may include one or more conventional mechanisms that permit a user to input information to and interact with the image production unit 100, such as a keyboard, a display, a mouse, a pen, a voice recognition device, touchpad, buttons, etc., for example. Output section 270 may include one or more conventional mechanisms that output image production documents to the user, including output trays, output paths, finishing section, etc., for example. The image processing section 290 may include an image printing and/or copying section, a scanner, a fuser, etc., for example.

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The image production device 100 illustrated in FIGS. 1-2 and the related discussion are intended to provide a brief, general description of a suitable communication and processing environment in which the disclosure may be implemented. Although not required, the disclosure will be described, at least in part, in the general context of computer-executable instructions, such as program modules, being executed by the image production device 100, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like.

Figure 3:
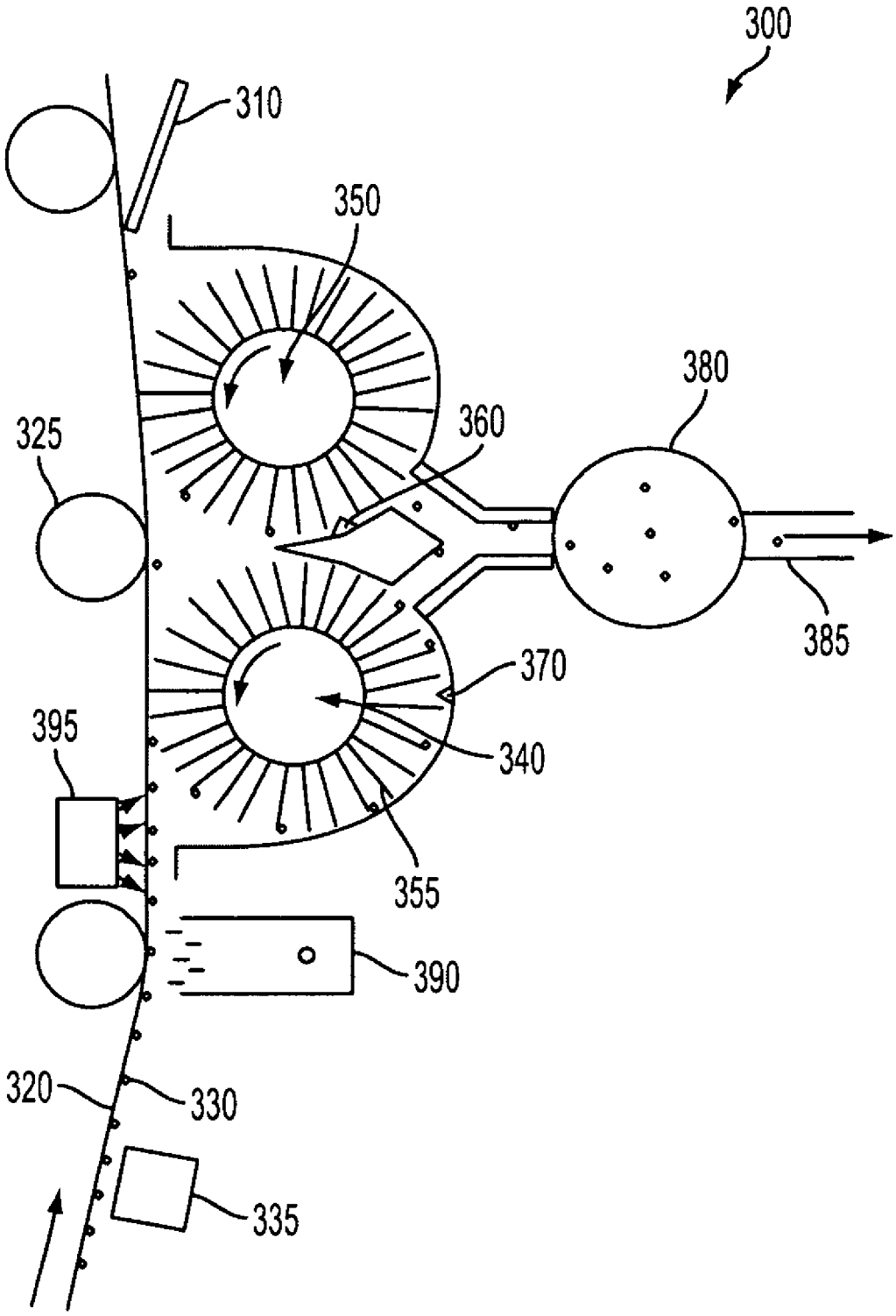
FIG. 3 is a diagram of an exemplary electrostatic brush section of an image production device in accordance with one possible embodiment of the disclosure.

FIG. 3 is a diagram of an exemplary electrostatic brush (ESB) cleaning section 300 of an image production device in accordance with one possible embodiment of the disclosure. Note that while one particular ESB cleaning section 300 configuration is shown, the ESB cleaning process disclosed herein may work with other ESB cleaning section configurations. The exemplary ESB cleaning section 300 may include a spots blade 310, a photoreceptor device 320, a plurality of rollers 325, excess toner particles 330, a first electrostatic brush (first ESB) 340, a second electrostatic brush 350 (second ESB), a plurality of electrostatic brush fibers (ESB fibers) 355 that are attached to the first and second ESBs 340, 350, a first flicker bar 360, a second flicker bar 370, an air manifold 380, a waste collection path 385, a pre-clean dicorotron (dicor) 390, and a pre-clean erase device 395. Note that while FIG. 3 shows 2 ESBs, only one or more than two ESBs may be used in the process described in the disclosed embodiments.

The photoreceptor device 320 is shown as a belt being moved by the plurality of rollers 325 which may be connected to a motor (not shown). The photoreceptor device 320 may also be drum or other device that may carry toner to be placed upon a document in the image production device 100.

In the electrostatic cleaning operation, excess toner particles 330 are left on the photoreceptor device 320 as a result of normal printing (a relatively small amount of toner) or from a paper jam in which no document image was transferred (a relatively large amount of toner), for example.

As the excess toner particles 330 move toward the ESBs 340, 350, the excess toner particles 330 may be given an optimal negative charge by the pre-clean dicor 390. The pre-clean erase device 395 (such as a lamp, etc., for example) may neutralize most of the charge remaining on the photoreceptor device 320. The first ESB 340 and its ESB fibers 355 may be positively-charged and may attract the negatively-charged excess toner particles 330 and the ESB fibers 355 pick up the excess toner particles 330.

As the first ESB 340 is rotated counterclockwise (or clockwise depending on the orientation of the ESB cleaning section 300 and/or the rotation of the photoreceptor device 320, the flicker bar 370 may loosen the excess toner particles 330 from the ESB fibers 355 and the excess toner particles 330 may be sucked into an air manifold 380. The excess toner particles 330 may then be sent through the waste collection path 385 and deposited into a waste collection point (not shown).

If any excess toner particles 330 evade the ESB fibers 355 of the first ESB 340 (due to being positively-charged, for example), the second ESB 350 may remove any residual toner. The second ESB 350 maybe negatively-charged and rotate in a counterclockwise direction or in the same direction as the first ESB 340. The excess toner particles 330 may be attracted to the ESB fibers 355 of the second ESB 350 and may be loosened by flicker bar 360. As with the operation of the first ESB 340, the excess toner particles 330 may be sucked into an air manifold 380, sent through the waste collection path 385, and deposited into a waste collection point.

Finally, if any excess toner particles 330 evade both the first and second ESBs 340, 350, the spots blade 310 may prevent particles from remaining on the photoreceptor device 320 by scraping them back into the path of the second ESB 350. Note that sensor 335 may be any type of sensor known to those of skill in the art that may be used to determine the amount of excess toner particles 330 on the photoreceptor device 320.

Note that within the spirit and scope of this disclosure, the ESBs 340, 350 may be rotated at at least two different speeds depending on the existence or non-existence of an image transfer (or paper jam that may prevent the image transfer) or the amount of excess toner particles 330 determined or sensed to exist on the photoreceptor device 320.

Figure 4:
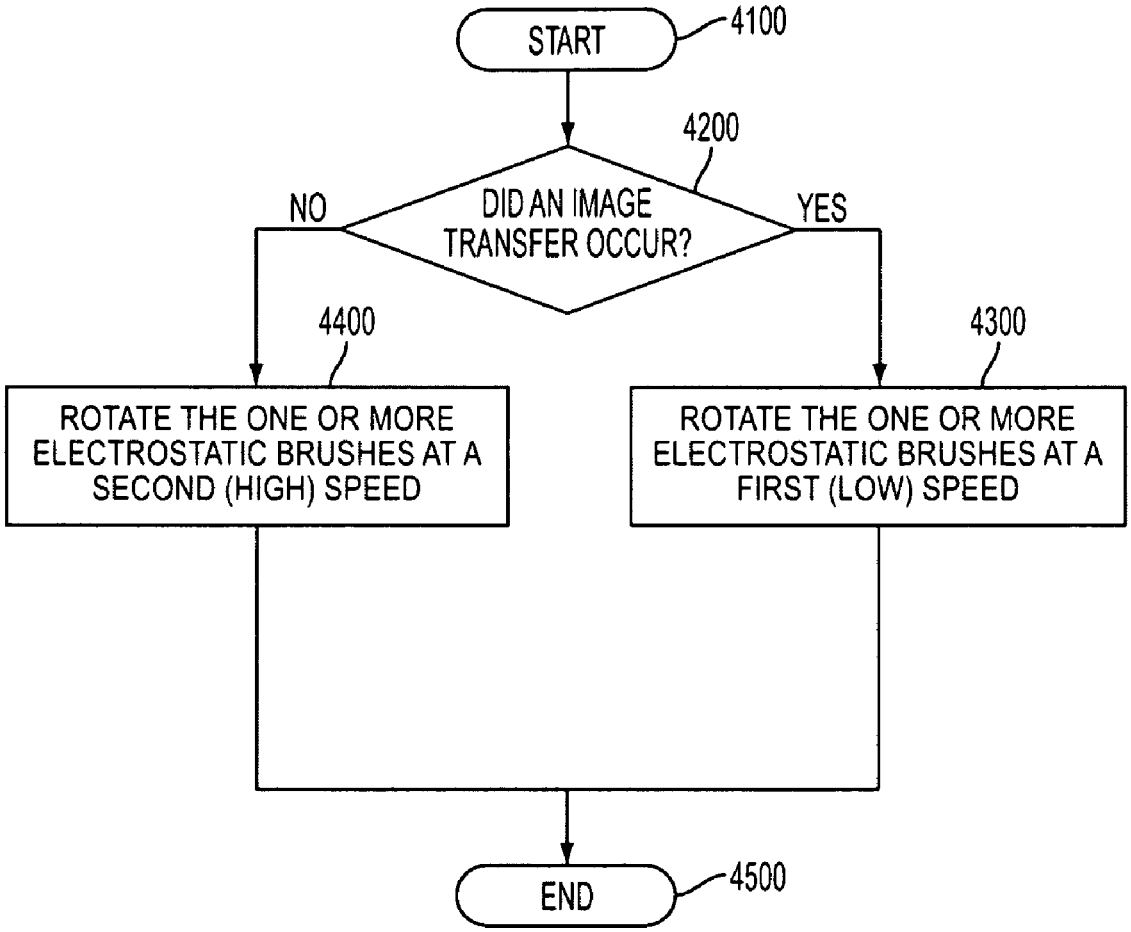
FIG. 4 is a flowchart of an exemplary electrostatic brush cleaning process in accordance with one possible embodiment of the disclosure.

For illustrative purposes, the operation of the ESB cleaner controller 250, the exemplary ESB cleaning section 300, and the exemplary electrostatic brush cleaning process are described in FIG. 4 in relation to the block diagrams shown in FIGS. 1-3.

FIG. 4 is a flowchart of an exemplary electrostatic brush cleaning process in accordance with one possible embodiment of the disclosure. The method begins at 4100, and continues to 4200 where the ESB cleaning controller 250 may determine if an image transfer occurred in the image production device. If the ESB cleaning controller 250 determines that an image transfer occurred, at step 4300, the ESB cleaning controller 250 may rotate the first and second ESB 340, 350 (or one or more electrostatic brushes) at a first (or low) speed. The process may then go to step 4500 and end.

If the ESB cleaning controller 250 determines that the image transfer did not occur, then at step 4400, the ESB cleaning controller 250 may rotate the one or more ESBs 340, 350 at a second (or high) speed. Note that the first speed is slower than the second speed. The process may then go to step 4500 and end.

Figure 5A:
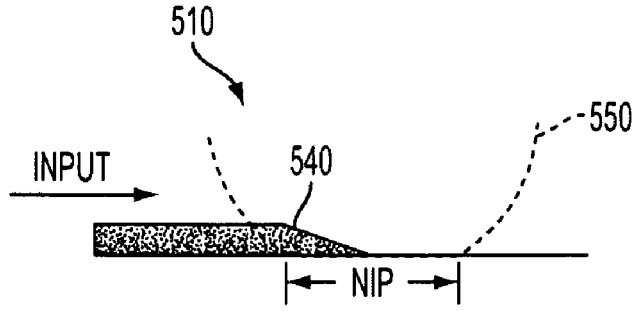
FIGS. 5A-5C are exemplary diagrams of electrostatic brush cleaning capacities in accordance with one possible embodiment of the disclosure.
Figure 5B:
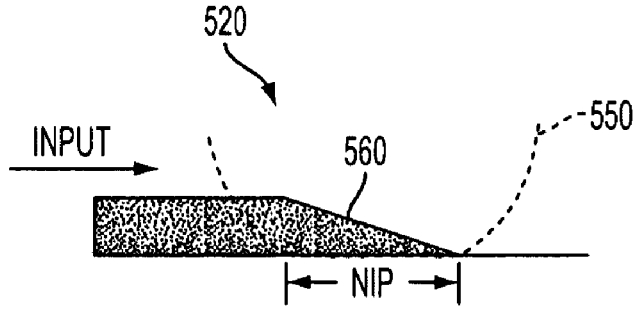
Figure 5C:
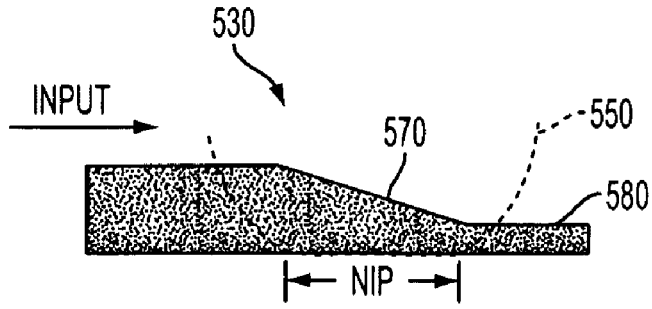

FIGS. 5A-5C are exemplary diagrams of electrostatic brush cleaning capacities in accordance with one possible embodiment of the disclosure. FIG. 5A illustrates a situation 510 where the ESBs 340, 350 having a nip 550 must clean excess toner particles 540 at less than a maximum capacity. FIG. 5B illustrates a situation 520 where the ESBs 340, 350 having a nip 550 must clean excess toner particles 560 at the maximum capacity. FIG. 5C illustrates a situation 530 where the ESBs 340, 350 having a nip 550 must clean excess toner particles 570 at more than a maximum capacity.

The maximum cleaning capacity may be defined as the continuous toner input density that can be completely cleaned in a single pass (or cycle) under the ESBs 340, 350. Toner inputs greater than the maximum cleaning capacity may require additional passes to clean. Each pass under the ESBs 340, 350 may remove an amount of toner up to the maximum cleaning capacity. In three cleaning passes, for example, a toner input equal to three times the maximum cleaning capacity may be cleaned.

At maximum cleaning capacity as shown in FIG. 5B, the full width of the cleaning nip 550 for ESBs 340 350 may be used to clean excess toner particles 560 from the photoreceptor device 320. As shown in FIG. 5A, excess toner particles 560 equal to half of the maximum cleaning capacity may require half of the cleaning nip 550 to clean the photoreceptor device 320. As shown in FIG. 5C, if there are excess toner particles 570 input greater than the maximum cleaning capacity, excess toner particles 580 may pass through the cleaning nip 550.

Non-continuous excess toner particles 570 greater than the cleaning capacity toner input density may be cleaned if they are not too long in the process direction. All ESB fibers 245 may be assumed to collect the same amount of excess toner particles 330 when cleaning at the maximum capacity or greater. The maximum amount of toner that may be cleaned within the brush nip 550 may be equal to the toner input rate (cleaning capacity toner input density times the photoreceptor device 320 speed) times the time to travel through the nip 550 (nip width÷photoreceptor speed). The result may be the cleaning capacity toner input density times the nip width 550. A toner density greater than the cleaning capacity toner input density ($SAD_{max}$) may be cleaned if the length of the image in the process direction (L) is equal to or less than the maximum amount of toner that can be cleaned in the brush nip ($SAD_{max} \times NIP$) divided by the toner density to be cleaned ($D_{in}$):

$$L=(SAD_{max} \times NIP)/D_{in}$$

As an example, a Φ60 cleaning brush with a 2 mm brush-to-photoreceptor interference may have a 21.5 mm nip width. The cleaning capacity may be 0.6 mg/cm$^2$ continuous solid area input. Since the maximum solid area developed density may be 1.2 mg/cm$^2$, two cleaning passes may be required for jam recovery. The ESB cleaning section 300 may be capable of cleaning the maximum solid area developed density (1.2 mg/cm$^2$) in a single cleaning pass if the length of the developed image is less than or equal to half of the nip width 550, or 10.75 mm. This length may be greater than any normal text font and typical features found on text pages. For half-toned images, the length of the image may be increased based on the reduction in toner density due to the percent half toning used. Therefore, even many longer untransferred image features may be cleanable in a single pass if their halftone densities ($D_{in}$) are sufficiently low.

Figure 6:
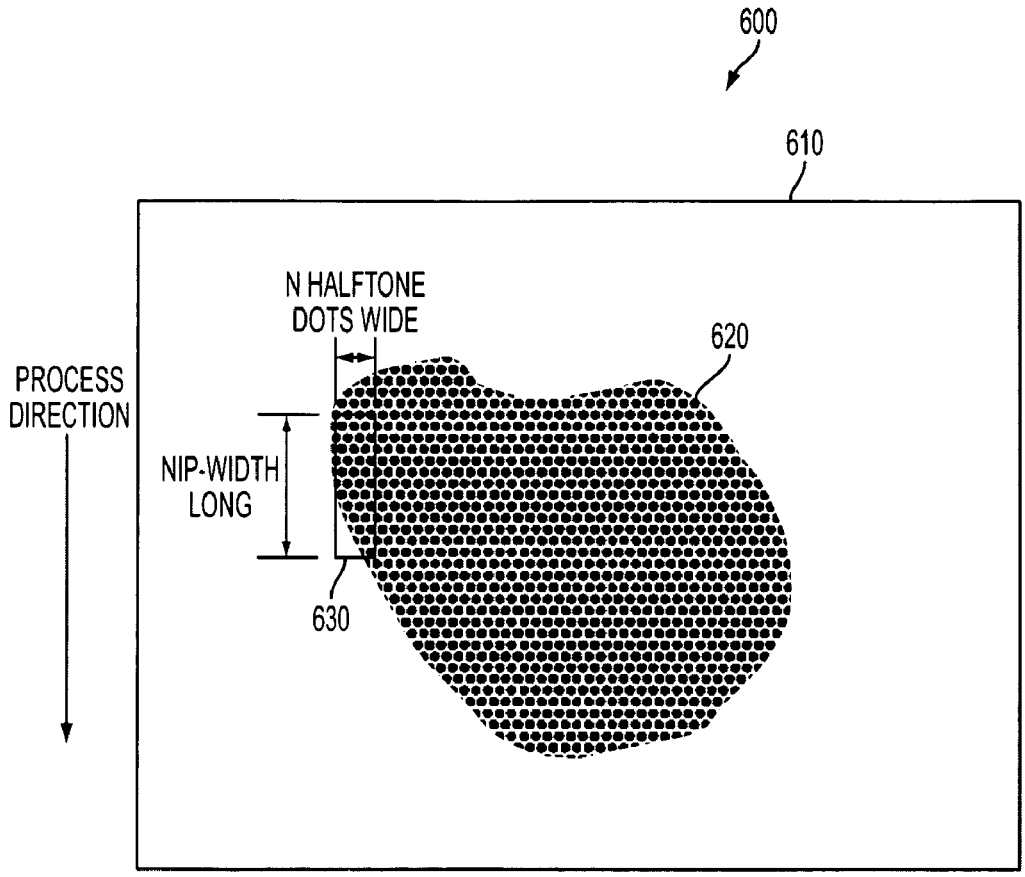
FIG. 6 is a diagram of an exemplary halftone dot counting process in accordance with one possible embodiment of the disclosure.

FIG. 6 is a diagram of an exemplary halftone dot counting process 600 in accordance with one possible embodiment of the disclosure. Since most image features do not have constant density, the process may be required to convert the requirement for single pass cleaning into a practical decision criteria. One feed-forward method may be to count the developed halftone dots of toner in the process direction. The exemplary halftone dot counting process diagram 600 shows developed halftone dots 620 on photoreceptor device 610. The developed halftone dots 620 are measured using a sampling zone 630 that is an ESB nip-width long by N halftone dots wide.

The number of halftone toner dots 620 in a length equal to the ESB cleaning nip 550 multiplied by the toner mass per dot and divided by the toner dot width may result in the input mass to the cleaner ($m_{in}$) that can be compared to the single pass cleaning requirement ($SAD_{max} \times NIP$). If the input mass to the ESBs 340, 350 is greater than the single pass cleaning requirement, then more than one jam recovery cycle may be required.

It is unlikely that a high density line only one halftone toner dot wide may not be cleaned in a single pass. Because of halftone dot pattern differences and differences between ESBs 340, 350, such as brush weave density, fiber length, interference-to-photoreceptor, speed and bias, the actual width of the line (N halftone dots wide) that could not be cleaned in a single pass may be determined experimentally for each specific ESB cleaning section 300. Instead of counting the toner halftone dots in a single process direction line, dots may be counted in a zone that is N dots wide. A register may record the maximum value within a page of a running sum of the number of toner dots in process direction sampling zones 630 having a length equal to the ESB cleaning nip width 550 by N halftone dots wide, as shown by the sampling zone 630, for example.

The maximum toner input mass, $M_{in}$, is the maximum number of toner halftone dots ($n_{max}$) inside a sampling zone 630 as long as the ESB cleaning nip width 550 in the process direction by N halftone dots wide anywhere on the page multiplied by the toner mass per halftone dot ($m_{dot}$) and divided by N halftone dot widths ($w_{dot}$).

$$M_{in}=(n_{max}\times m_{dot})/(N\times w_{dot})$$

If the maximum input mass to the cleaner ($M_{in}$) may be less than or equal to the single pass cleaning requirement ($SAD_{max}\times NIP$), then only a single jam recovery cycle may be needed. If the input mass to the cleaner may greater than the single pass cleaning requirement but less than twice the single pass cleaning requirement, then two jam recovery cycles may be needed. The total number of required jam recovery cycles may be one plus the integer part of $M_{in}/(SAD_{max}\times NIP)$.

In a similar manner a full-width array sensor (micro-densitometer array) could be used to measure toner input to the cleaner. Measurements within a specified width zone in the process direction may be integrated to determine the excess toner particle mass 330 into the cleaner over a length equal to the brush nip width 550. The maximum excess toner particle mass 330 into the ESBs 340, 350 measured within the page for all process direction zones may be compared to the single pass cleaning requirement to determine the number of jam recovery cycles required.

The full-width array sensor may also be used to determine the number of jam recovery cleaning passes required by directly measuring the amount of excess toner particles 330 that passes under the ESBs 340, 350. Jam recovery cycles may be continued until the full width array senses that the photoreceptor device 320 has been completely cleaned. By combining the feed-forward process of determining the required number of jam recovery cycles from the electronic data representing the image and full-width array sensing of the actual excess toner particles 330 on the photoreceptor device 320, the feed-forward process may be verified.

This process may also serve as a check on machine performance. If the feed-forward prediction of the required number of jam recovery cleaning cycles at high ESB speed is less than the actual number of required cleaning cycles, then either the excess toner particle 330 input rate to the ESBs 340, 350 may be greater than expected or the cleaning capacity of the ESBs 340, 350 may have deteriorated more than expected. Such a condition may indicate the need for diagnostic evaluation of development and/or ESB cleaning section 300 functions. In the case of the ESB cleaning section 300, this condition may indicate the need to replace worn or contaminated ESBs 340, 350. Failure to achieve feed forward predictions of cleaning transferred images at slow ESB speed may indicate the need for diagnostic evaluation of development, transfer and/or ESB cleaning section 300 functions.

Jam recovery may not be the only normal occurrence of high density toner images entering the ESB cleaning section 300. Control patches and other features developed outside of the document area may regularly enter the cleaner without having gone through transfer. Typically these features may be given several passes through the ESB cleaning section 300 to be removed. The patches may be developed at a low enough frequency to allow several cleaning passes or they can be moved in position to allow multiple cleaning passes without interrupting normal print productivity. If the ESB cleaning section 300 is operating in the reduced cleaning capacity mode and an untransferred patch must be cleaned more quickly, then the brush speed may be increased momentarily for the high cleaning stress of the patch and then returned to the reduced cleaning capacity mode.

In consideration of the above where the ESBs 340, 350 may be operated at at least two speed whereby the first speed is slower than the second speed, the ESB cleaning controller 250 may determine if the excess toner particles 330 have been removed from the photoreceptor device 320. If the ESB cleaning controller 250 determines that the excess toner particles 330 have not been removed, the ESB cleaning controller 250 may rotate the one or more ESBs 340, 350 at the second speed for a second cycle.

The ESB cleaning controller 250 may determine an amount of excess toner particles 330 to be removed from the photoreceptor device 320. The ESB cleaning controller 250 may then determine a maximum amount of excess toner particles 330 that can be removed on one cleaning cycle. Using this information, the ESB cleaning controller 250 may determine a number of cleaning cycles needed to clean the excess toner particles 330 based on the determined amount of excess toner particles 330 to be removed from the photoreceptor device 320 and the determined maximum amount of excess toner particles 330 that can be removed on one cleaning cycle.

The sensor 335 may sense an amount of excess toner particles 330 on the photoreceptor device 320. The ESB cleaning controller 250 may determine the speed of the one or more ESBs 340, 350 based on the received sensor 335 input. The ESB cleaning controller 250 may also determine the number of cleaning cycles needed to remove the excess toner particles from the photoreceptor device 320 based on the received sensor 335 input.

The sensor 335 may also measure excess toner particles 330 input to the one or more ESBs 340, 350. The ESB cleaning controller 250 may determine the number of cleaning cycles needed to remove the excess toner particles 330 from the photoreceptor device 320 based on the measured excess toner particles 330.

The sensor 335 may also serve to count a number of halftone dots 620 of excess toner particles 330 in a direction in which the image transfer was to occur. The ESB cleaning controller 250 may then determine the number of cleaning cycles needed to remove the excess toner particles 330 from the photoreceptor device 320 based on the number of halftone dots 620 of excess toner particles 330 counted.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD- ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for electrostatic brush cleaning of excess toner particles on a photoreceptor device in an image production device, comprising:

determining if an image transfer occurred in the image production device, wherein if it is determined that the image transfer occurred, rotating one or more electrostatic brushes at a first speed, and wherein if it is determined that the image transfer did not occur, rotating the one or more electrostatic brushes at a second speed, wherein the first speed is slower than the second speed.

2. The method of claim 1, further comprising:

determining if the excess toner particles have been removed from the photoreceptor device, wherein if it is determined that the excess toner particles have not been removed from the photoreceptor device, rotating the one or more electrostatic brushes at the second speed for an additional cycle.

3. The method of claim 1, further comprising:

determining an amount of excess toner particles to be removed from the photoreceptor device;

determining a maximum amount of excess toner particles that can be removed on one cleaning cycle; and determining a number of cleaning cycles needed to clean the excess toner particles based on the determined amount of excess toner particles to be removed from the photoreceptor device and the determined maximum amount of excess toner particles that can be removed on one cleaning cycle.

4. The method of claim 1, further comprising:

receiving an input from a sensor, wherein the sensor input concerns an amount of excess toner particles on the photoreceptor device.

5. The method of claim 4, further comprising:

determining the speed of the one or more electrostatic brushes based on the received sensor input.

6. The method of claim 4, further comprising:

determining the number of cleaning cycles needed to remove the excess toner particles from the photoreceptor device based on the received sensor input.

7. The method of claim 1, further comprising:

measuring excess toner particles input to the one or more electrostatic brushes; and determining the number of cleaning cycles needed to remove the excess toner particles from the photoreceptor device based on the measured excess toner particles.

8. The method of claim 1, further comprising:

counting a number of halftone dots of toner in a direction in which the image transfer was to occur; and determining the number of cleaning cycles needed to remove the excess toner particles from the photoreceptor device based on the number of halftone dots of excess toner particles counted.

9. The method of claim 1, wherein the image production device is one of a copier, a printer, a facsimile device, and a multi-function device.

10. An image production device, comprising:

a photoreceptor device;

one or more electrostatic brushes that remove excess toner particles from the photoreceptor device; and an electrostatic brush cleaning controller that determines if an image transfer occurred in the image production device, wherein if electrostatic brush cleaning controller determines that the image transfer occurred, the electrostatic brush cleaning controller rotates the one or more electrostatic brushes at a first speed, and if the electrostatic brush cleaning controller determines that image transfer did not occur, the electrostatic brush cleaning controller rotates the one or more electrostatic brushes at a second speed, wherein the first speed is slower than the second speed.

11. The image production device of claim 10, wherein the electrostatic brush cleaning controller determines if the excess toner particles have been removed from the photoreceptor device, wherein if the electrostatic brush cleaning controller determines that the excess toner particles have not been removed from the photoreceptor device, the electrostatic brush cleaning controller rotates the one or more electrostatic brushes at the second speed for an additional cycle.

12. The image production device of claim 10, wherein the electrostatic brush cleaning controller determines an amount of excess toner particles to be removed from the photoreceptor device, determines a maximum amount of excess toner particles that can be removed on one cleaning cycle, and determines a number of cleaning cycles needed to clean the excess toner particles based on the determined amount of excess toner particles to be removed from the photoreceptor device and the determined maximum amount of excess toner particles that can be removed on one cleaning cycle.

13. The image production device of claim 10, further comprising:

a sensor that senses an amount of excess toner particles on the photoreceptor device.

14. The image production device of claim 13, wherein the electrostatic brush cleaning controller determines the speed of the one or more electrostatic brushes based on the received sensor input.

15. The image production device of claim 13, wherein the electrostatic brush cleaning controller determines the number of cleaning cycles needed to remove the excess toner particles from the photoreceptor device based on the received sensor input.

16. The image production device of claim 10, further comprising:

a sensor that measures excess toner particles input to the one or more electrostatic brushes, wherein the electrostatic brush cleaning controller determines the number of cleaning cycles needed to remove the excess toner particles from the photoreceptor device based on the measured excess toner particles.

17. The image production device of claim 10, further comprising:

a sensor that counts a number of halftone dots of toner in a direction in which the image transfer was to occur, wherein the electrostatic brush cleaning controller determines a number of cleaning cycles needed to remove the excess toner particles from the photoreceptor device based on the number of halftone dots of excess toner particles counted.

18. The image production device of claim 10, wherein the image production device is one of a copier, a printer, a facsimile device, and a multi-function device.

19. An electrostatic brush cleaning section for use in an image production device, comprising:

a photoreceptor device; and one or more electrostatic brushes that remove excess toner particles from the photoreceptor device, wherein if an image transfer occurred in the image production device, the one or more electrostatic brushes rotate at a first speed, and if the image transfer did not occur, the one or more electrostatic brushes rotate at a second speed, wherein the first speed is slower than the second speed.

20. The electrostatic brush cleaning section of claim 19, wherein the image production device is one of a copier, a printer, a facsimile device, and a multi-function device.

* * * * *